US011227534B2

(12) United States Patent
Liu et al.

(10) Patent No.: US 11,227,534 B2
(45) Date of Patent: Jan. 18, 2022

(54) DISPLAY DRIVING CIRCUIT, DISPLAY DRIVING METHOD AND DISPLAY DEVICE

(71) Applicant: BOE TECHNOLOGY GROUP CO., LTD., Beijing (CN)

(72) Inventors: Dongni Liu, Beijing (CN); Lei Wang, Beijing (CN); Minghua Xuan, Beijing (CN); Xiaochuan Chen, Beijing (CN); Shengji Yang, Beijing (CN); Liang Chen, Beijing (CN); Li Xiao, Beijing (CN); Zheng Fang, Beijing (CN); Detao Zhao, Beijing (CN); Pengcheng Lu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 243 days.

(21) Appl. No.: 16/611,742

(22) PCT Filed: Mar. 22, 2019

(86) PCT No.: PCT/CN2019/079222
§ 371 (c)(1),
(2) Date: Nov. 7, 2019

(87) PCT Pub. No.: WO2019/218772
PCT Pub. Date: Nov. 21, 2019

(65) Prior Publication Data
US 2021/0335215 A1 Oct. 28, 2021

(51) Int. Cl.
*G09G 3/32* (2016.01)

(52) U.S. Cl.
CPC ..... *G09G 3/32* (2013.01); *G09G 2300/0426* (2013.01); *G09G 2310/0218* (2013.01)

(58) Field of Classification Search
CPC ..... G09G 3/32; G09G 3/3677; G09G 3/3676; G09G 3/3696; G09G 3/20; G09G 3/2092;
(Continued)

(56) References Cited

U.S. PATENT DOCUMENTS 10,825,396 B2 * 11/2020 Chen ..... G09G 3/3258
11,049,428 B1 * 6/2021 Zhou ..... G09G 3/20
(Continued)

FOREIGN PATENT DOCUMENTS

CN 101329484 A 12/2008
CN 102820007 A 12/2012
(Continued)

OTHER PUBLICATIONS

First Office Action for Chinese Application No. 201810479786.8, dated Sep. 4, 2019, 8 Pages.
(Continued)

*Primary Examiner* — Vijay Shankar
(74) *Attorney, Agent, or Firm* — Brooks Kushman P.C.

(57) ABSTRACT

A display driving circuit includes N levels of display driving sub-circuits and N levels of switching sub-circuits. Each display driving sub-circuit is connected to a corresponding switching sub-circuit. An nth-level display driving sub-circuit includes an nth-level gate driving sub-circuit and an nth-level light-emitting control sub-circuit. An nth-level switching sub-circuit includes an nth-level gate driving switching sub-circuit and an nth-level light-emitting, control switching sub-circuit. The nth-level gate driving switching sub-circuit is configured to enable an nth-level gate driving signal output end to be electrically connected to a (2n−1)th gate line or a 2nth gate line. The nth-level light-emitting control switching sub-circuit is configured to enable an nth-level light-emitting control signal output end to be electrically connected to a (2n−1)th light-emitting control line or a 2nth light-emitting control line, where N is an integer greater than 1, and n is a positive integer smaller than or equal to N.

16 Claims, 4 Drawing Sheets

(58) Field of Classification Search
CPC ... G09G 2300/0408; G09G 2300/0426; G09G 2310/0218; G09G 2310/0267; G09G 2320/0204; G09G 2330/04; G09G 2310/0286; G09G 2310/08; G09G 2310/06; G09G 2310/0224; G09G 2310/0291; G09G 2320/0219; G11C 19/28; G11C 19/287
See application file for complete search history.

(56) References Cited

U.S. PATENT DOCUMENTS

| | | | | |
|---|---|---|---|---|
| 11,081,058 | B2 * | 8/2021 | Feng | G09G 3/3674 |
| 2004/0066358 | A1 | 4/2004 | Numao | |
| 2008/0316159 | A1 | 12/2008 | Qi | |
| 2015/0279266 | A1 | 10/2015 | Onoyama et al. | |
| 2016/0012764 | A1 | 1/2016 | Xu | |
| 2017/0116926 | A1 | 4/2017 | Bong et al. | |
| 2017/0154572 | A1 | 6/2017 | Kim et al. | |
| 2018/0083078 | A1 | 3/2018 | Park et al. | |
| 2018/0130407 | A1 | 5/2018 | Zhai | |
| 2020/0051507 | A1 * | 2/2020 | Feng | G09G 3/3266 |
| 2020/0074929 | A1 * | 3/2020 | Chen | G09G 3/3258 |
| 2021/0201809 | A1 * | 7/2021 | Feng | G11C 19/28 |

FOREIGN PATENT DOCUMENTS

| | | | |
|---|---|---|---|
| CN | 102881248 | A | 1/2013 |
| CN | 103474040 | A | 12/2013 |
| CN | 106816136 | A | 6/2017 |
| CN | 106971692 | A | 7/2017 |
| CN | 106991945 | A | 7/2017 |
| CN | 107657918 | A | 2/2018 |
| CN | 107863071 | A | 3/2018 |
| CN | 108806592 | A | 11/2018 |
| JP | 2004177926 | A | 6/2004 |
| KR | 20120077792 | A | 7/2012 |

OTHER PUBLICATIONS

International Search Report and Written Opinion for Application No. PCT/CN2019/079222, dated Jun. 24, 2019, 10 Pages.

* cited by examiner

DISPLAY DRIVING CIRCUIT, DISPLAY DRIVING METHOD AND DISPLAY DEVICE

CROSS-REFERENCE TO RELATED APPLICATION APPLICATIONS

This application is the U.S. national phase of PCT Application No. PCT/CN2019/079222 filed on Mar. 22, 2019, which claims priority to Chinese Patent Application No. 201810479786.8 filed on May 18, 2018, which are incorporated herein by, reference in their entireties.

TECHNICAL FIELD

The present disclosure relates to the field of display driving technology, in particular to a display driving circuit, a display driving method and a display device.

BACKGROUND

Currently, organic light-emitting diode (OLED) display devices have attracted more and more attentions in the display field. However, it is necessary for an OLED pixel circuit having an internal compensation circuit to drive a pixel to emit light through a light-emitting control signal and a gate driving signal, so as to display an image. A conventional display driving circuit includes a light-emitting control circuit and a gate driving circuit. The gate driving circuit includes M gate driving units connected to each other in a cascaded manner, and the light-emitting control circuit includes M light-emitting control units connected to each other in a cascaded manner, where M is a positive integer and also represents the quantity of rows of the pixel circuits included in the OLED display device. Due to a large quantity of transistors, a large layout space of a display back plate is occupied by the conventional display driving circuit, so it is very difficult to provide the display device with a narrow bezel.

SUMMARY

In one aspect, the present disclosure provides in some embodiments a display driving circuit, including N levels of display driving sub-circuits and N levels of switching sub-circuits. Each display driving sub-circuit is connected to a corresponding switching sub-circuit. An nth-level display driving sub-circuit includes an nth-level gate driving sub-circuit and an nth-level light-emitting control sub-circuit. An nth-level switching sub-circuit includes an nth-level gate driving switching sub-circuit and an nth-level light-emitting control switching sub-circuit. The nth-level gate driving sub-circuit is configured to output a corresponding gate driving signal via an nth-level gate driving signal output end. The nth-level light-emitting control sub-circuit is configured to output a corresponding light-emitting control signal via an nth-level light-emitting control signal output end. N is an integer greater than 1, and n is a positive integer smaller than or equal to N. The nth-level gate driving switching sub-circuit is configured to, at an odd-numbered row display stage of a display period, control the nth-level gate driving signal output end to be electrically connected to a (2n−1)th gate line under the control of a switching control end. The nth-level light-emitting control switching sub-circuit is configured to, at the odd-numbered row display stage, control the nth-level light-emitting control signal output end to be electrically connected to an (2n−1)th light-emitting control line under the control of the switching control end. The nth-level gate driving switching sub-circuit is further configured to, at an even-numbered row display stage of the display period, control the nth-level gate driving signal output end to be electrically connected to a 2nth gate line under the control of the switching control end. The nth-level light-emitting control switching sub-circuit is further configured to, at the even-numbered row display period, control the nth-level light-emitting control signal output end to be electrically connected to a 2nth light-emitting control line under the control of the switching control end.

In a possible embodiment of the present disclosure, the nth-level gate driving switching sub-circuit is further configured to, at the even-numbered row display stage of the display period, control the nth-level gate driving signal output end to be electrically disconnected from the (2n−1)th gate line under the control of the switching control end. The nth-level light-emitting control switching sub-circuit is further configured to, at the even-numbered row display stage, control the nth-level light-emitting control signal output end to be electrically disconnected from the (2n−1)th light-emitting control line under the control of the switching control end. The nth-level gate driving switching sub-circuit is further configured to, at the odd-numbered row display stage of the display period, control the nth-level gate driving signal output end to be electrically disconnected from the 2nth gate line under the control of the switching control end. The nth-level light-emitting control switching sub-circuit is further configured to, at the odd-numbered row display stage, control the nth-level light-emitting control signal output end to be electrically disconnected from the 2nth light-emitting control line under the control of the switching control end.

In a possible embodiment of the present disclosure, the switching control end includes a first switching control end and a second switching control end. The nth-level gate driving switching sub-circuit includes: a (2n−1)th gate driving switching transistor, a gate electrode of which is connected to the first switching control end, a first electrode of which is connected to the (2n−1)th gate line, and a second electrode of which is connected to the nth-level gate driving signal output end; and a 2nth gate driving switching transistor, a gate electrode of which is connected to the second switching control end, a first electrode of which is connected to the nth-level gate driving signal output end, and a second electrode of which is connected to the 2nth gate line. The nth-level light-emitting control switching sub-circuit includes: a (2n−1)th light-emitting control switching transistor, a gate electrode of which is connected to the first switching control end, a first electrode of which is connected to the (2n−1)th light-emitting control line, and a second electrode of which is connected to the nth-level light-emitting control signal output end; and a 2nth light-emitting control switching transistor, a gate electrode of which is connected to the second switching control end, a first electrode of which is connected to the nth-level light-emitting control signal output end, and a second electrode of which is connected to the 2nth light-emitting control line.

In a possible embodiment of the present disclosure, the (2n−1)th gate driving switching transistor, the 2nth gate driving switching transistor, the (2n−1)th light-emitting control switching transistor and the 2nth light-emitting control switching transistor are all N-type transistors.

In a possible embodiment of the present disclosure, the (2n−1)th gate driving switching transistor, the 2nth gate driving switching transistor, the (2n−1)th light-emitting control switching transistor and the 2nth light-emitting control switching transistor are all P-type transistors.

In a possible embodiment of the present disclosure, the nth-level gate driving switching sub-circuit includes: a (2n−1)th gate driving switching transistor, a gate electrode of which is connected to the switching control end, a first electrode of which is connected to the (2n−1)th gate line, and a second electrode of which is connected to the nth-level gate driving signal output end; and a 2nth gate driving switching transistor, a gate electrode of which is connected to the switching control end, a first electrode of which is connected to the nth-level gate driving signal output end, and a second electrode of which is connected to the 2nth gate line. The nth-level light-emitting control switching sub-circuit includes: a (2n−1)th light-emitting control switching transistor, a gate electrode of which is connected to the switching control end, a first electrode of which is connected to the (2n−1)th light-emitting control line, and a second electrode of which is connected to the nth-level light-emitting control signal output end; and a 2nth light-emitting control switching transistor, a gate electrode of which is connected to the switching control end, a first electrode of which is connected to the nth-level light-emitting control signal output end, and a second electrode of which is connected to the 2nth light-emitting control line.

In a possible embodiment of the present disclosure, the (2n−1)th gate driving switching transistor and the (2n−1)th light-emitting control switching transistor are N-type transistors, and the 2nth gate driving switching transistor and the 2nth light-emitting control switching transistor are P-type transistors.

In a possible embodiment of the present disclosure, the (2n−1)th gate driving switching transistor and the (2n−1)th light-emitting control switching transistor are P-type transistors, and the 2nth gate driving switching transistor and the 2nth light-emitting control switching transistor are N-type transistors.

In a possible embodiment of the present disclosure, the N levels of display driving sub-circuits are arranged sequentially. The nth-level display driving sub-circuit includes the nth-level gate driving sub-circuit and the nth-level light-emitting control sub-circuit arranged sequentially, or the nth-level display driving sub-circuit includes the nth-level light-emitting control sub-circuit and the nth-level gate driving sub-circuit arranged sequentially.

In a possible embodiment of the present disclosure, an mth-level gate driving sub-circuit includes an mth-level gate driving input end, and an mth-level light-emitting control sub-circuit includes an mth-level light-emitting control input end. The mth-level gate driving input end is connected to an (m−1)th-level gate driving signal output end of an (m−1)th-level gate driving sub-circuit, and the mth-level light-emitting control input end is connected to an (m−1)th-level light-emitting control signal output end of an (m−1)th-level light-emitting control sub-circuit, where m is an integer greater than 1 and smaller than or equal to N.

In a possible embodiment of the present disclosure, the nth-level gate driving sub-circuit includes a first transistor, a second transistor, a third transistor, a fourth transistor, a fifth transistor, a sixth transistor, a seventh transistor, an eighth transistor, a first storage capacitor and a second storage capacitor.

In a possible embodiment of the present disclosure, the nth-level light-emitting control sub-circuit includes a ninth transistor, a tenth transistor, an eleventh transistor, a twelfth transistor, a thirteenth transistor, a fourteenth transistor, a fifteenth transistor, a sixteenth transistor, a seventeenth transistor, an eighteenth transistor, a nineteenth transistor, a twentieth transistor, a twenty-first transistor, a third storage capacitor, a fourth storage capacitor and a fifth storage capacitor.

In another aspect, the present disclosure provides in some embodiments a display driving method of the above-mentioned display driving circuit. A display period of the display driving circuit includes an odd-numbered row display stage and an even-numbered row display stage. The display driving method includes: at the odd-numbered row display stage, controlling, by an nth-level gate driving switching sub-circuit, an nth-level gate driving signal output end to be electrically connected to a (2n−1)th gate line under the control of a switching control end, and controlling, by an nth-level light-emitting control switching sub-circuit, an nth-level light-emitting control signal output end to be electrically connected to a (2n−1)th light-emitting control line under the control of the switching control end; and at the even-numbered row display stage, controlling, by the nth-level gate driving switching sub-circuit, the nth-level gate driving signal output end to be electrically connected to a 2nth gate line under the control of the switching control end, and controlling, by the nth-level light-emitting control switching sub-circuit, the nth-level light-emitting control signal output end to be electrically connected to a 2nth light-emitting control line under the control of the switching control end.

In a possible embodiment of the present disclosure, the display driving method further includes: at the even-numbered row display stage, controlling, by the nth-level gate driving switching sub-circuit, the nth-level gate driving signal output end to be electrically disconnected from the (2n−1)th gate line under the control of the switching control end, and controlling, by the nth-level light-emitting control switching sub-circuit, the nth-level light-emitting control signal output end to be electrically disconnected from the (2n−1)th light-emitting control line under the control of the switching control end; and at the odd-numbered row display stage, controlling, by the nth-level gate driving switching sub-circuit, the nth-level gate driving signal output end to be electrically disconnected from the 2nth gate line under the control of the switching control end, and controlling, by the nth-level light-emitting control switching sub-circuit, the nth-level light-emitting control signal output end to be electrically disconnected from the 2nth light-emitting control line under the control of the switching control end.

In a possible embodiment of the present disclosure, the display period includes the odd-numbered row display stage and the even-numbered row display stage arranged sequentially, or the display period includes the even-numbered row display stage and the odd-numbered row display stage arranged sequentially.

In yet another aspect, the present disclosure provides in some embodiments a display device including the above-mentioned display driving circuit.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION

Figure 1:
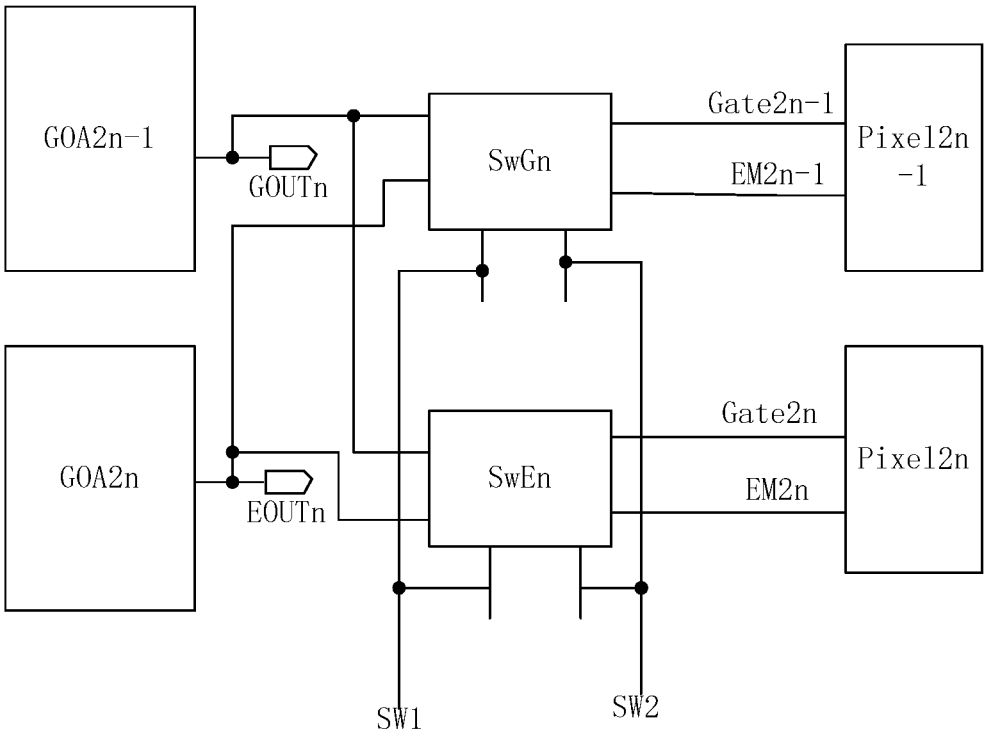
FIG. 1 is a schematic view showing an nth-level display driving sub-circuit of a display driving circuit according to one embodiment of the present disclosure.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be thin film transistors (TFTs), field effect transistors (FETs) or any other elements having an identical characteristic. In order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode.

The present disclosure provides in some embodiments a display driving circuit which includes N levels of display driving sub-circuits and N levels of switching sub-circuits. Each display driving sub-circuit is connected to a corresponding switching sub-circuit. An nth-level display driving sub-circuit includes an nth-level gate driving sub-circuit and an nth-level light-emitting control sub-circuit. An nth-level switching sub-circuit includes an nth-level gate driving switching sub-circuit and an nth-level light-emitting control switching sub-circuit. The nth-level gate driving sub-circuit is configured to output a corresponding gate driving signal via an nth-level gate driving signal output end. The nth-level light-emitting control sub-circuit is configured to output a corresponding light-emitting control signal via an nth-level light-emitting control signal output end. N is an integer greater than 1, and n is a positive integer smaller than or equal to N. The nth-level gate driving switching sub-circuit is configured to, at an odd-numbered row display stage of a display period, control the nth-level gate driving signal output end to be electrically connected to a (2n−1)th gate line under the control of a switching control end. The nth-level light-emitting control switching sub-circuit is configured to, at the odd-numbered row display stage, control the nth-level light-emitting control signal output end to be electrically connected to an (2n−1)th light-emitting control line under the control of the switching control end. The nth-level gate driving switching sub-circuit is further configured to, at an even-numbered row display stage of the display period, control the nth-level gate driving signal output end to be electrically connected to a 2nth gate line under the control of the switching control end. The nth-level light-emitting control switching sub-circuit is further configured to, at the even-numbered row display period, control the nth-level light-emitting control signal output end to be electrically connected to a 2nth light-emitting control line under the control of the switching control end.

The nth-level gate driving sub-circuit may be provided with the nth-level gate driving signal output end, and the nth-level light-emitting control sub-circuit may be provided with the nth-level light-emitting control signal output end.

According to the embodiments of the present disclosure, the display driving circuit may include N levels of display driving sub-circuits and N levels of switching sub-circuits. The nth-level display driving sub-circuit may include the nth-level gate driving sub-circuit and the nth-level light-emitting control sub-circuit, and the nth-level switching sub-circuit may include the nth-level gate driving switching sub-circuit and the nth-level light-emitting control switching sub-circuit. Hence, it is able for the display driving circuit in the embodiments of the present disclosure to provide both a gate driving signal and a light-emitting control signal. In addition, the quantity of the gate driving sub-circuits in the display driving circuit may be half of the quantity of the gate driving sub-circuits in the conventional display driving circuit, so it is able to reduce the quantity of the transistors, thereby to provide a display device with a barrow bezel.

The display driving circuit in the embodiments of the present disclosure may include N levels of switching sub-circuits (e.g., each level of switching sub-circuit merely includes four transistors, so the quantity of the transistors of the switching sub-circuit is far less than the quantity of the transistors of each display driving sub-circuit). The nth-level switching sub-circuit may include the nth-level gate driving switching sub-circuit and the nth-level light-emitting control switching sub-circuit. The nth-level gate driving switching sub-circuit may be connected to the nth-level gate driving signal output end, the (2n−1)th gate line and the 2nth gate line, and configured to, at the odd-numbered row display stage, control the nth-level gate driving signal output end to be electrically connected to the (2n−1)th gate line to apply a corresponding gate driving signal to pixel units in odd-numbered rows, and at the even-numbered row display stage, control the nth-level gate driving signal output end to be electrically connected to the 2nth gate line to apply a corresponding gate driving signal to pixel units in even-numbered rows. The nth-level light-emitting control switching sub-circuit may be connected to the nth-level light-emitting control signal output end, the (2n−1)th light-emitting control line and the 2nth light-emitting control line, and configured to, at the odd-numbered row display stage, control the nth-level light-emitting control signal output end to be electrically connected to the (2n−1)th light-emitting control line to apply a corresponding light-emitting control signal to the pixel units in the odd-numbered rows, and at the even-numbered row display stage, control the nth-level light-emitting control signal output end to be electrically connected to the 2nth light-emitting control line to apply a corresponding light-emitting control signal to the pixel units in the even-numbered rows.

For the display driving circuit in the embodiments of the present disclosure, each display frame (i.e., each display period) may include the odd-numbered row display stage and the even-numbered row display stage. The pixel units in the odd-numbered rows and the pixel units in the even-numbered rows on a display panel may achieve a display function separately, i.e., the gate lines may be scanned in an interlaced manner within each display period. To be specific, at the odd-numbered row display stage, the odd-numbered gate lines may be scanned sequentially and the corresponding light-emitting control signal may be applied to the odd-numbered light-emitting control line, and at the even-numbered row display stage, the even-numbered gate lines may be scanned sequentially and the corresponding light-emitting control signal may be applied to the even-numbered light-emitting control line. During the operation of a display device including the display driving circuit in the embodiments of the present disclosure, the pixel units in the odd-numbered rows may be used for displaying a half frame of image, and the pixel units in the even-numbered rows may be used for displaying the other half frame of image. Of course, the present disclosure may not be limited thereto. For example, a length of a display period for the pixel units in the odd-numbered rows and a length of a display period for the pixel units in the even-numbered rows may be set according to the practical need, e.g., a quarter of a frame of image display time.

During the implementation, the nth-level gate driving switching sub-circuit is further configured to, at the even-numbered row display stage of the display period, control the nth-level gate driving signal output end to be electrically disconnected from the (2n−1)th gate line under the control of the switching control end. The nth-level light-emitting control switching sub-circuit is further configured to, at the even-numbered row display stage, control the nth-level light-emitting control signal output end to be electrically disconnected from the (2n−1)th light-emitting control line under the control of the switching control end. The nth-level gate driving switching sub-circuit is further configured to, at the odd-numbered row display stage of the display period, control the nth-level gate driving signal output end to be electrically disconnected from the 2nth gate line under the control of the switching control end. The nth-level light-emitting control switching sub-circuit is further configured to, at the odd-numbered row display stage, control the nth-level light-emitting control signal output end to be electrically disconnected from the 2nth light-emitting control line under the control of the switching control end.

In actual use, the switching control end may include merely one control end, or include a first switching control end and a second switching control end.

During the implementation, when the switching control end includes the first switching control end and the second switching control end, the nth-level gate driving switching sub-circuit is further configured to, at the odd-numbered row display stage of the display period, control the nth-level gate driving signal output end to be electrically connected to the (2n−1)th gate line under the control of the first switching control end, and the nth-level light-emitting control switching sub-circuit is further configured to, at the odd-numbered row display stage, control the nth-level light-emitting control signal output end to be electrically connected to the (2n−1)th light-emitting control line under the control of the first switching control end. The nth-level gate driving switching sub-circuit is further configured to, at the even-numbered row display stage of the display period, control the nth-level gate driving signal output end to be electrically connected to the 2nth gate line under the control of the second switching control end, and the nth-level light-emitting control switching sub-circuit is further configured to, at the even-numbered row display stage, control the nth-level light-emitting control signal output end to be electrically connected to the 2nth light-emitting control line under the control of the second switching control end.

The nth-level gate driving switching sub-circuit is further configured to, at the even-numbered row display stage of the display period, control the nth-level gate driving signal output end to be electrically disconnected from the (2n−1)th gate line under the control of the first switching control end, and the nth-level light-emitting control switching sub-circuit is further configured to, at the even-numbered row display stage, control the nth-level light-emitting control signal output end to be electrically disconnected from the (2n−1)th light-emitting control line under the control of the first switching control end. The nth-level gate driving switching sub-circuit is further configured to, at the odd-numbered row display stage of the display period, control the nth-level gate driving signal output end to be electrically disconnected from the 2nth gate line under the control of the second switching control end. The nth-level light-emitting control switching sub-circuit is further configured to, at the odd-numbered row display stage, control the nth-level light-emitting control signal output end to be electrically disconnected from the 2nth light-emitting control line under the control of the second switching control end.

FIG. 1 shows the nth-level display driving sub-circuit included in the display driving circuit.

In FIG. 1, GOA2*n*−1 represents the nth-level gate driving sub-circuit, GOA2*n* represents the nth-level light-emitting control sub-circuit, SwGn represents the nth-level gate driving switching sub-circuit, SwEn represents the nth-level light-emitting control switching sub-circuit, SW1 represents the first switching control end, SW2 represents the second switching control end, Pixel2*n*−1 represents pixel units in a (2n−1)th row, Pixel2*n* represents pixel units in an 2nth row, Gate2*n*−1 represents the (2n−1)th gate line, EM2*n*−1 represents the (2n−1)th light-emitting control line, Gate2*n* represents the 2nth gate line, and EM2*n* represents the 2nth light-emitting control line.

In FIG. 1, GOA2*n*−1 includes the nth-level gate driving signal output end GOUTn (i.e., GOA2*n*−1 is connected to the nth-level gate driving signal output end GOUTn), and GOA2*n* includes the nth-level light-emitting control signal output end EOUTn (i.e., GOA2*n* is connected to the nth-level light-emitting control signal output end EOUTn).

In FIG. 1, Pixel2*n*−1 is connected to Gate2*n*−1 and EM2*n*−1, Gate2*n*−1 is configured to apply a corresponding gate driving signal to Pixel2*n*−1, and EM2*n*−1 is configured to apply a corresponding light-emitting control signal to Pixel2*n*−1. In actual use, there is a plurality of pixel units in the (2n−1)th row, and there is a plurality of pixel units in the 2nth row. FIG. 1 merely illustratively shows one pixel unit in the (2n−1)th row and one pixel unit in the 2nth row.

For the nth-level display driving sub-circuit in FIG. 1, a first control end of SwGn is connected to SW1, a second control end of SwGn is connected to SW2, a first control end of SwEn is connected to SW1, and a second control end of SwEn is connected to SW2.

SwGn is further connected to EM2*n*−1, Gate2*n*−1, the nth-level gate driving signal output end GOUTn of GOA2*n*−1 and the nth-level light-emitting control signal output end EOUTn of GOA2*n*, and configured to, at the odd-numbered row display stage of the display period, control GOUTn to be electrically connected to Gate2*n*−1 and control EOUTn to be electrically connected to EM2*n*−1 under the control of SW1 so as to apply the corresponding gate driving signal and the corresponding light-emitting control signal to the pixel units in the odd-numbered rows, and at the even-numbered row display stage of the display period, control GOUTn to be electrically disconnected from Gate2*n*−1 and control EOUTn to be electrically disconnected from EM2$n$−1 under the control of SW1 so as not to apply the corresponding gate driving signal and the corresponding light-emitting control signal to the pixel units in the odd-numbered rows.

SwEn is further connected to EM2$n$, Gate2$n$, the nth-level gate driving signal output end GOUTn of GOA2$n$−1 and the nth-level light-emitting control signal output end EOUTn of GOA2$n$, and configured to, at the even-numbered row display stage of the display period, control GOUTn to be electrically connected to Gate2$n$ and control EOUTn to be electrically connected to EM2$n$ under the control of SW2 so as to apply the corresponding gate driving signal and the corresponding light-emitting control signal to the pixel units in the even-numbered rows, and at the odd-numbered row display stage of the display period, control GOUTn to be electrically disconnected from Gate2$n$−1 and control EOUTn to be electrically disconnected from EM2$n$ under the control of SW2 so as not to apply the corresponding gate driving signal and the corresponding light-emitting control signal to the pixel units in the even-numbered rows.

In a possible embodiment of the present disclosure, the switching control end may include a first switching control end and a second switching control end. The nth-level gate driving switching sub-circuit may include: a (2n−1)th gate driving switching transistor, a gate electrode of which is connected to the first switching control end, a first electrode of which is connected to the (2n−1)th gate line, and a second electrode of which is connected to the nth-level gate driving signal output end; and a 2nth gate driving switching transistor, a gate electrode of which is connected to the second switching control end, a first electrode of which is connected to the nth-level gate driving signal output end, and a second electrode of which is connected to the 2nth gate line. The nth-level light-emitting control switching sub-circuit may include: a (2n−1)th light-emitting control switching transistor, a gate electrode of which is connected to the first switching control end, a first electrode of which is connected to the (2n−1)th light-emitting control line, and a second electrode of which is connected to the nth-level light-emitting control signal output end; and a 2nth light-emitting control switching transistor, a gate electrode of which is connected to the second switching control end, a first electrode of which is connected to the nth-level light-emitting control signal output end, and a second electrode of which is connected to the 2nth light-emitting control line. The (2n−1)th gate driving switching transistor, the 2nth gate driving switching transistor, the (2n−1)th light-emitting control switching transistor and the 2nth light-emitting control switching transistor may be all P-type transistors.

In another possible embodiment of the present disclosure, the nth-level gate driving switching sub-circuit may include: a (2n−1)th gate driving switching transistor, a gate electrode of which is connected to the switching control end, a first electrode of which is connected to the (2n−1)th gate line, and a second electrode of which is connected to the nth-level gate driving signal output end; and a 2nth gate driving switching transistor, a gate electrode of which is connected to the switching control end, a first electrode of which is connected to the nth-level gate driving signal output end, and a second electrode of which is connected to the 2nth gate line. The nth-level light-emitting control switching sub-circuit may include: a (2n−1)th light-emitting control switching transistor, a gate electrode of which is connected to the switching control end, a first electrode of which is connected to the (2n−1)th light-emitting control line, and a second electrode of which is connected to the nth-level light-emitting control signal output end; and a 2nth light-emitting control switching transistor, a gate electrode of which is connected to the switching control end, a first electrode of which is connected to the nth-level light-emitting control signal output end, and a second electrode of which is connected to the 2nth light-emitting control line. The (2n−1)th gate driving switching transistor and the (2n−1)th light-emitting control switching transistor are N-type transistors, and the 2nth gate driving switching transistor and the 2nth light-emitting control switching transistor are P-type transistors, or the (2n−1)th gate driving switching transistor and the (2n−1)th light-emitting control switching transistor are P-type transistors, and the 2nth gate driving switching transistor and the 2nth light-emitting control switching transistor are N-type transistors.

To be specific, the N levels of display driving sub-circuits may be arranged sequentially. The nth-level display driving sub-circuit may include the nth-level gate driving sub-circuit and the nth-level light-emitting control sub-circuit arranged sequentially, or the nth-level display driving sub-circuit may include the nth-level light-emitting control sub-circuit and the nth-level gate driving sub-circuit arranged sequentially.

For example, the N levels of display driving sub-circuits may be arranged sequentially from top to bottom, or from bottom to top, at a side of a display substrate.

In FIG. 1, odd-numbered-level modules of the display driving circuit may be the gate driving sub-circuits, and even-numbered-level modules of the display driving circuit may be the light-emitting control sub-circuits. However, the present disclosure may not be limited thereto. In actual use, the odd-numbered-level modules of the display driving circuit may be the light-emitting control sub-circuits, and the even-numbered-level modules of the display driving circuit may be the gate driving sub-circuits.

To be specific, an mth-level gate driving sub-circuit may include an mth-level gate driving input end, and an mth-level light-emitting control sub-circuit may include an mth-level light-emitting control input end. The mth-level gate driving input end may be connected to an (m−1)th-level gate driving signal output end of an (m−1)th-level gate driving sub-circuit, and the mth-level light-emitting control input end may be connected to an (m−1)th-level light-emitting control signal output end of an (m−1)th-level light-emitting control sub-circuit, where m is an integer greater than 1 and smaller than or equal to N.

In actual use, the N levels of gate driving sub-circuits of the display driving circuit may be connected to each other in a cascaded manner, and the N levels of light-emitting control sub-circuits of the display driving circuit may be connected to each other in a cascaded manner. To be specific, an input end of a first-level gate driving sub-circuit of the display driving circuit is configured to receive a gate driving start signal, and an input end of each of the other gate driving sub-circuits may be connected to a gate driving signal output end of a previous-level gate driving sub-circuit. An input end of a first-level light-emitting control sub-circuit of the display driving circuit is configured to receive a light-emitting control start signal, and an input end of each of the other light-emitting control sub-circuits may be connected to a light-emitting control signal output end of a previous-level light-emitting control sub-circuit.

Figure 2:
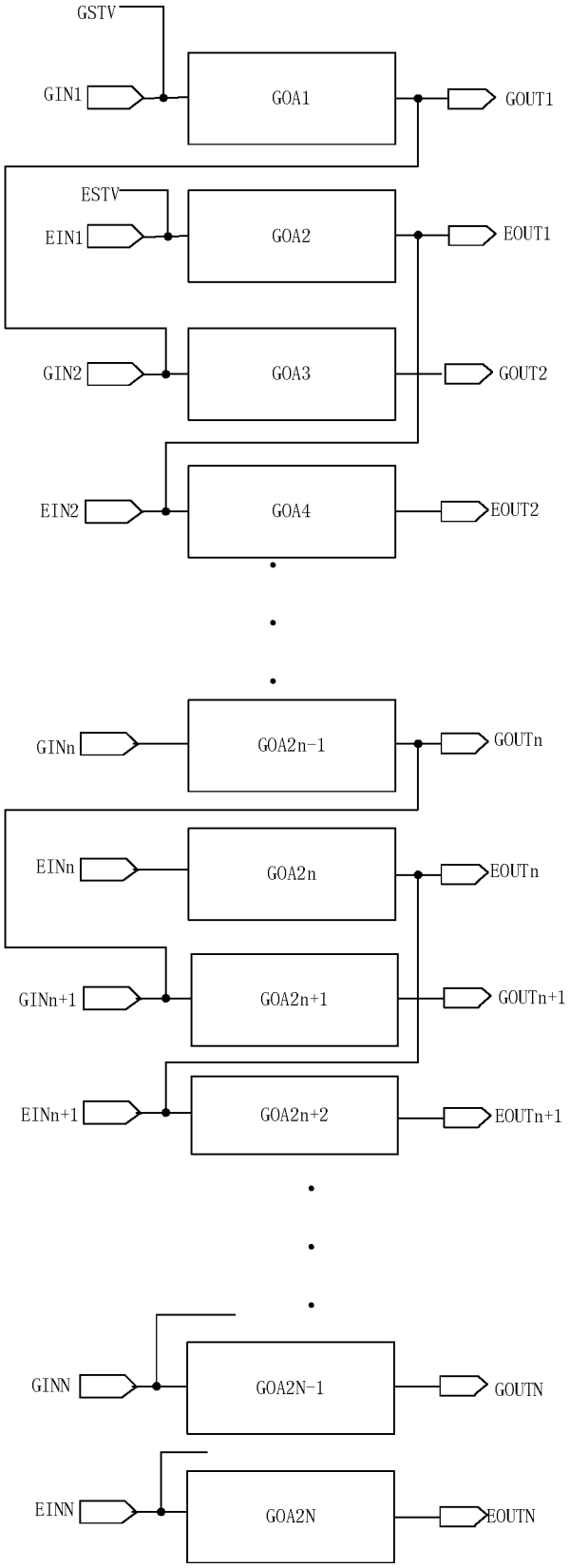
FIG. 2 is a schematic view showing a cascading relationship among multiple levels of gate driving sub-circuits and a cascading relationship among multiple levels of light-emitting control sub-circuits included in N levels of display driving sub-circuits of the display driving circuit according to one embodiment of the present disclosure.

FIG. 2 shows a cascading relationship among the multiple levels of the gate driving sub-circuits and a cascading relationship among the multiple levels of the light-emitting control sub-circuits of the N levels of display driving sub-circuits of the display driving circuit. Each level of display driving sub-circuit may include the gate driving sub-circuit and the light-emitting control sub-circuit, where N is an integer greater than 1, and n is a positive integer smaller than or equal to N. The multiple levels of switching sub-circuits of the display driving circuit are not shown in FIG. 2.

In FIG. 2, GOA1 represents a first-level gate driving sub-circuit of a first-level display driving sub-circuit and includes a first-level gate driving signal output end GOUT1, and GOA2 represents a first-level light-emitting control sub-circuit of the first-level display driving sub-circuit and includes a first-level light-emitting control signal output end EOUT1 (i.e., GOA2 is connected to the first-level light-emitting control signal output end EOUT1). GOA1 further includes a first-level gate driving input end GIN1 (i.e., GOA1 is further connected to the first-level gate driving input end GIN1). GOA2 further includes a first-level light-emitting control input end EIN1 (i.e., GOA2 is further connected to the first-level light-emitting control input end EIN1). GIN1 is configured to receive a gate driving start signal GSTV, and EIN1 is configured to receive a light-emitting control start signal ESTV.

GOA3 represents a second-level gate driving sub-circuit of a second-level display driving sub-circuit and includes a second-level gate driving signal output end GOUT2 (i.e., GOA3 is connected to the second-level gate driving signal output end GOUT2), and GOA4 represents a second-level light-emitting control sub-circuit of the second-level display driving sub-circuit and includes a second-level light-emitting control signal output end EOUT2 (i.e., GOA4 is connected to the second-level light-emitting control signal output end EOUT2). GOA3 further includes a second-level gate driving input end GIN2 (i.e., GOA3 is further connected to the second-level gate driving input end GIN2). GOA4 further includes a second-level light-emitting control input end EIN2 (i.e., GOA4 is further connected to the second-level light-emitting control input end EIN2). GIN2 is connected to GOUT1, and EIN2 is connected to EOUT1.

GOA2*n*−1 represents the nth-level gate driving sub-circuit of the nth-level display driving sub-circuit and includes the nth-level gate driving signal output end GOUTn (i.e., GOA2*n*−1 is connected to the nth-level gate driving signal output end GOUTn), and GOA2*n* represents the nth-level light-emitting control sub-circuit of the nth-level display driving sub-circuit and includes the nth-level light-emitting control signal output end EOUTn (i.e., GOA2*n* is connected to the nth-level light-emitting control signal output end EOUTn). GOA2*n*−1 further includes an nth-level gate driving input end GINn (i.e., GOA2*n*−1 is further connected to the nth-level gate driving input end GINn). GOA2*n* further includes an nth-level light-emitting control input end EINn (i.e., GOA2*n* is further connected to the nth-level light-emitting control input end EINn). GINn is connected to the nth-level gate driving signal output end (not shown) of an $(n-1)^{th}$ gate driving sub-circuit of an $(n-1)^{th}$ display driving sub-circuit, and EINn is connected to an nth-level light-emitting control signal output end (not shown) of an $(n-1)^{th}$ light-emitting control sub-circuit of the $(n-1)^{th}$ display driving sub-circuit.

GOA2*n*+1 represents an $(n+1)^{th}$-level gate driving sub-circuit of an $(n+1)^{th}$-level display driving sub-circuit and includes an $(n+1)^{th}$-level gate driving signal output end GOUTn+1 (i.e., GOA2*n*+1 is connected to the $(n+1)^{th}$-level gate driving signal output end GOUTn+1), and GOA2*n*+2 represents the $(n+1)^{th}$-level light-emitting control sub-circuit of the $(n+1)^{th}$-level display driving sub-circuit and includes the $(n+1)^{th}$-level light-emitting control signal output end EOUTn+1 (i.e., GOA2*n*+2 is connected to the $(n+1)^{th}$-level light-emitting control signal output end EOUTn+1). GOA2*n*+1 further includes an $(n+1)^{th}$-level gate driving input end GINn+1 (i.e., GOA2*n*+1 is further connected to the $(n+1)^{th}$-level gate driving input end GINn+1). GOA2*n*+2 further includes an $(n+1)^{th}$-level light-emitting control input end EINn+1 (i.e., GOA2*n*+2 is further connected to the $(n+1)^{th}$-level light-emitting control input end EINn+1). GINn+1 is connected to GOUTn, and EINn+1 is connected to EOUTn.

GOA2N−1 represents an Nth-level gate driving sub-circuit of an Nth-level display driving sub-circuit and includes an Nth-level gate driving signal output end GOUTN (i.e., GOA2N−1 is connected to the Nth-level gate driving signal output end GOUTN), and GOA2N represents the Nth-level light-emitting control sub-circuit of the Nth-level display driving sub-circuit and includes the Nth-level light-emitting control signal output end EOUTN (i.e., GOA2N is connected to the Nth-level light-emitting control signal output end EOUTN). GOA2N−1 further includes an Nth-level gate driving input end GINN (i.e., GOA2N−1 is further connected to the Nth-level gate driving input end GINN). GOA2N further includes an Nth-level light-emitting control input end EINN (i.e., GOA2N is further connected to the Nth-level light-emitting control input end EINN). GINN is connected to an Nth-level gate driving signal output end (not shown) of an $(N-1)^{th}$-level gate driving sub-circuit of an $(N-1)^{th}$-level display driving sub-circuit, and EINN is connected to an Nth-level light-emitting control signal output end (not shown) of an $(N-1)^{th}$-level light-emitting control sub-circuit of the $(N-1)^{th}$-level display driving sub-circuit.

For the display driving circuit in FIG. 2, the odd-numbered-level modules are the gate driving sub-circuits, and the even-numbered-level modules are the light-emitting control sub-circuits. However, the present disclosure may not be limited thereto. In actual use, the odd-numbered-level modules may be the light-emitting control sub-circuits, and the even-numbered-level modules may be the gate driving sub-circuits.

The nth-level display driving sub-circuit of the display driving circuit will be described hereinafter in conjunction with two embodiments.

Figure 3:
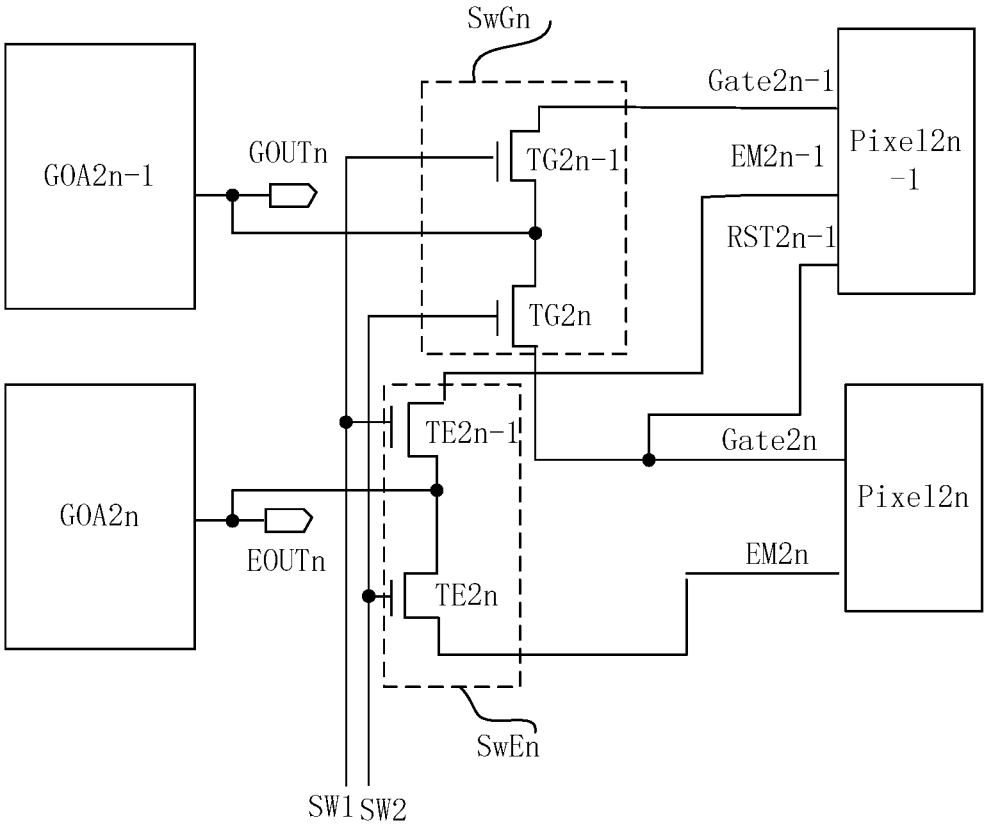
FIG. 3 is a schematic view showing the nth-level display driving sub-circuit according to one embodiment of the present disclosure.

As shown in FIG. 3, on the basis of the nth-level display driving sub-circuit in FIG. 1, for the nth-level display driving sub-circuit in a first embodiment of the present disclosure, the nth-level gate driving switching sub-circuit SwGn may include: a (2n−1)th gate driving switching transistor TG2*n*−1, a gate electrode of which is connected to the first switching control end SW1, a drain electrode of which is connected to the (2n−1)th gate line Gate2*n*−1, and a source electrode of which is connected to the nth-level gate driving signal output end GOUTn; and a 2nth gate driving switching transistor TG2*n*, a gate electrode of which is connected to the second switching control end SW2, a drain electrode of which is connected to the nth-level gate driving signal output end GOUTn, and a source electrode of which is connected to the 2nth gate line Gate2*n*. The nth-level light-emitting control switching sub-circuit SwEn may include: a (2n−1)th light-emitting control switching transistor TE2*n*−1, a gate electrode of which is connected to the first switching control end SW1, a drain electrode of which is connected to the (2n−1)th light-emitting control line EM2*n*−1, and a source electrode of which is connected to the nth-level light-emitting control signal output end EOUTn; and a 2nth light-emitting control switching transistor TE2*n*, a gate electrode of which is connected to the second switching control end SW2, a drain electrode of which is connected to the nth-level light-emitting control signal output end EOUTn, and a source electrode of which is connected to the 2nth light-emitting control line EM2*n*.

In the nth-level display driving sub-circuit as shown in FIG. 3, TG2*n*, TG2*n*−1, TE2*n*−1 and TE2*n* may be, but not limited to, N-type transistors.

During the operation of the nth-level display driving sub-circuit in FIG. 3, at the odd-numbered row display stage of the display period, SW1 may output a high level, and SW2 may output a low level, so as to turn on TG2*n*−1 and TE2*n*−1, thereby to enable Gate2*n*−1 to be electrically connected to GOUTn, and enable EM2*n*−1 to be electrically connected to EOUTn. At this time, a corresponding gate driving signal and a corresponding light-emitting control signal may be applied to Pixel2*n*−1. In addition, TG2*n* and TE2*n* may be turned off, so as not to apply the corresponding gate driving signal and the corresponding light-emitting control signal to Pixel2*n*. At the even-numbered row display stage of the display period, SW1 may output a low level and SW2 may output a high level, so as to turn on TG2*n* and TE2*n*, thereby to enable Gate2*n* to be electrically connected to GOUTn, and enable EM2*n* to be electrically connected to EOUTn. At this time, a corresponding gate driving signal and a corresponding light-emitting control signal may be applied to Pixel2*n*. In addition, TG2*n*−1 and TE2*n*−1 may be turned off, so as not to apply the corresponding gate driving signal and the corresponding light-emitting control signal to Pixel2*n*−1.

In FIG. 3, Gate2*n* is configured to provide a resetting signal to a resetting end RESET2*n*−1 of Pixel2*n*−1.

Figure 4:
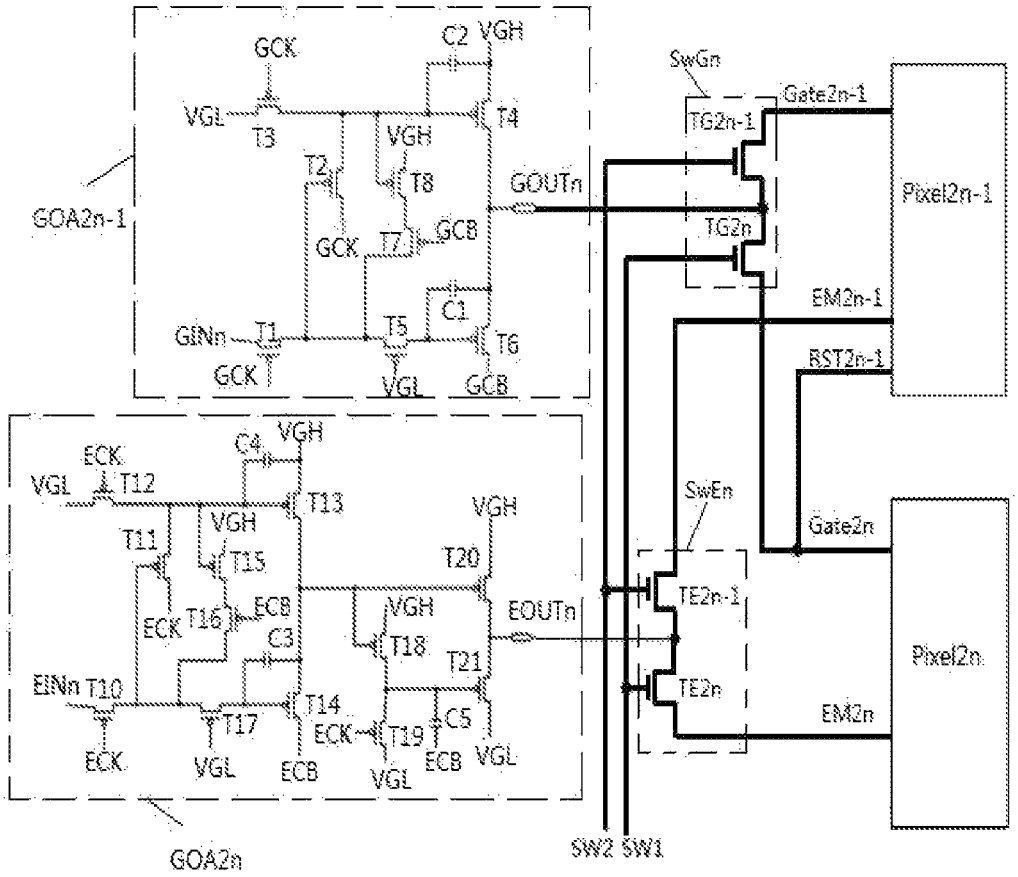
FIG. 4 is another schematic view showing the nth-level display driving sub-circuit according to one embodiment of the present disclosure.

As shown in FIG. 4, on the basis of the nth-level display driving sub-circuit in FIG. 3, for the nth-level display driving sub-circuit in a second embodiment of the present disclosure, GOA2*n*−1 may include a first transistor T1, a second transistor T2, a third transistor T3, a fourth transistor T4, a fifth transistor T5, a sixth transistor T6, a seventh transistor T7, an eighth transistor T8, a first storage capacitor C1 and a second storage capacitor C2. In FIG. 4, VGL represents a low voltage, VGH represents a high voltage, GCK represents a first gate driving clock signal, GCB represents a second gate driving clock signal, and GINn represents the nth-level gate driving input end.

GOA2*n* may include a ninth transistor T9, a tenth transistor T10, an eleventh transistor T11, a twelfth transistor T12, a thirteenth transistor T13, a fourteenth transistor T14, a fifteenth transistor T15, a sixteenth transistor T16, a seventeenth transistor T17, an eighteenth transistor T18, a nineteenth transistor T19, a twentieth transistor T20, a twenty-first transistor T21, a third storage capacitor C3, a fourth storage capacitor C4 and a fifth storage capacitor C5. In FIG. 4, EINn represents the nth-level light-emitting control input end, ECK represents a first light-emitting control clock signal, and ECB represents a second light-emitting control clock signal.

The present disclosure further provides in some embodiments a display driving method of the above-mentioned display driving circuit. A display period of the display driving circuit includes an odd-numbered row display stage and an even-numbered row display stage. The display driving method includes: at the odd-numbered row display stage, controlling, by an nth-level gate driving switching sub-circuit, an nth-level gate driving signal output end to be electrically connected to a (2n−1)th gate line under the control of a switching control end, and controlling, by an nth-level light-emitting control switching sub-circuit, an nth-level light-emitting control signal output end to be electrically connected to a (2n−1)th light-emitting control line under the control of the switching control end; and at the even-numbered row display stage, controlling, by the nth-level gate driving switching sub-circuit, the nth-level gate driving signal output end to be electrically connected to a 2nth gate line under the control of the switching control end, and controlling, by the nth-level light-emitting control switching sub-circuit, the nth-level light-emitting control signal output end to be electrically connected to a 2nth light-emitting control line under the control of the switching control end.

To be specific, the display driving method may further include: at the even-numbered row display stage, controlling, by the nth-level gate driving switching sub-circuit, the nth-level gate driving signal output end to be electrically disconnected from the (2n−1)th gate line under the control of the switching control end, and controlling, by the nth-level light-emitting control switching sub-circuit, the nth-level light-emitting control signal output end to be electrically disconnected from the (2n−1)th light-emitting control line under the control of the switching control end; and at the odd-numbered row display stage, controlling, by the nth-level gate driving switching sub-circuit, the nth-level gate driving signal output end to be electrically disconnected from the 2nth gate line under the control of the switching control end, and controlling, by the nth-level light-emitting control switching sub-circuit, the nth-level light-emitting control signal output end to be electrically disconnected from the 2nth light-emitting control line under the control of the switching control end.

In a possible embodiment of the present disclosure, the display period may include the odd-numbered row display stage and the even-numbered row display stage arranged sequentially. In actual use, within each display period, the odd-numbered gate lines may be scanned and the light-emitting control signal may be applied to the pixel circuits in the odd-numbered rows at first, so as to control the pixel circuits in the odd-numbered rows to emit light. Then, the even-numbered gate lines may be scanned and the light-emitting control signal may be applied to the pixel circuits in the even-numbered rows, so as to control the pixel circuits in the even-numbered rows to emit light.

In another possible embodiment of the present disclosure, the display period may include the even-numbered row display stage and the odd-numbered row display stage arranged sequentially. In actual use, within each display period, the even-numbered gate lines may be scanned and the light-emitting control signal may be applied to the pixel circuits in the even-numbered rows at first, so as to control the pixel circuits in the even-numbered rows to emit light. Then, the odd-numbered gate lines may be scanned and the light-emitting control signal may be applied to the pixel circuits in the odd-numbered rows, so as to control the pixel circuits in the odd-numbered rows to emit light.

The present disclosure further provides in some embodiments a display device including the above-mentioned display driving circuit.

The display device may be any product or member having a display function, e.g., electronic paper, OLED display device, mobile phone, flat-panel computer, television, display, laptop computer, digital photo frame or navigator.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A display driving circuit, comprising a GOA device comprising at least two GOA units which are cascaded among multiple levels of gate driving sub-circuits and multiple levels of light-emitting control sub-circuits of N levels of display driving sub-circuits of the display driving circuit, the display driving circuit comprising N levels of display driving sub-circuits and N levels of switching sub-circuits, wherein each display driving sub-circuit is connected to a corresponding switching sub-circuit; an nth-level display driving sub-circuit comprises an nth-level gate driving sub-circuit and an nth-level light-emitting control sub-circuit; an nth-level switching sub-circuit comprises an nth-level gate driving switching sub-circuit and an nth-level light-emitting control switching sub-circuit; the nth-level gate driving sub-circuit is configured to output a corresponding gate driving signal via an nth-level gate driving signal output end; the nth-level light-emitting control sub-circuit is configured to output a corresponding light-emitting control signal via an nth-level light-emitting control signal output end; the nth-level gate driving switching sub-circuit is configured to, at an odd-numbered row display stage of a display period, control the nth-level gate driving signal output end to be electrically connected to a (2n−1)th gate line under the control of a switching control end; the nth-level light-emitting control switching sub-circuit is configured to, at the odd-numbered row display stage, control the nth-level light-emitting control signal output end to be electrically connected to an (2n−1)th light-emitting control line under the control of the switching control end; the nth-level gate driving switching sub-circuit is further configured to, at an even-numbered row display stage of the display period, control the nth-level gate driving signal output end to be electrically connected to a 2nth gate line under the control of the switching control end; and the nth-level light-emitting control switching sub-circuit is further configured to, at the even-numbered row display period, control the nth-level light-emitting control signal output end to be electrically connected to a 2nth light-emitting control line under the control of the switching control end, wherein N is an integer greater than 1, and n is a positive integer smaller than or equal to N.

2. The display driving circuit according to claim 1, wherein the nth-level gate driving switching sub-circuit is further configured to, at the even-numbered row display stage of the display period, control the nth-level gate driving signal output end to be electrically disconnected from the (2n−1)th gate line under the control of the switching control end;

the nth-level light-emitting control switching sub-circuit is further configured to, at the even-numbered row display stage, control the nth-level light-emitting control signal output end to be electrically disconnected from the (2n−1)th light-emitting control line under the control of the switching control end;

the nth-level gate driving switching sub-circuit is further configured to, at the odd-numbered row display stage of the display period, control the nth-level gate driving signal output end to be electrically disconnected from the 2nth gate line under the control of the switching, control end; and the nth-level light-emitting control switching sub-circuit is further configured to, at the odd-numbered row display stage, control the nth-level light-emitting control signal output end to be electrically disconnected from the 2nth light-emitting control line under the control of the switching control end.

3. The display driving circuit according to claim 1, wherein the switching control end comprises a first switching control end and a second switching control end, the nth-level gate driving switching sub-circuit comprises: a (2n−1)th gate driving switching transistor, a gate electrode of which is connected to the first switching control end, a first electrode of which is connected to the (2n−1)th gate line, and a second electrode of which is connected to the nth-level gate driving signal output end; and a 2nth gate driving switching transistor, a gate electrode of which is connected to the second switching control end, a first electrode of which is connected to the nth-level gate driving signal output end, and a second electrode of which is connected to the 2nth gate line, and the nth-level light-emitting control switching sub-circuit comprises: a (2n−1)th light-emitting control switching transistor, a gate electrode of which is connected to the first switching control end, a first electrode of which is connected to the (2n−1)th light-emitting control line, and a second electrode of which is connected to the nth-level light-emitting control signal output end; and a 2nth light-emitting control switching transistor, a gate electrode of which is connected to the second switching control end, a first electrode of which is connected to the nth-level light-emitting control signal output end, and a second electrode of which is connected to the 2nth light-emitting control line.

4. The display driving circuit according to claim 3, wherein the (2n−1)th gate driving switching transistor, the 2nth gate driving switching transistor, the (2n−1)th light-emitting control switching transistor and the 2nth light-emitting control switching transistor are all N-type transistors.

5. The display driving circuit according to claim 3, wherein the (2n−1)th gate driving switching transistor, the 2nth gate driving switching transistor, the (2n−1)th light-emitting control switching transistor and the 2nth light-emitting control switching transistor are all P-type transistors.

6. The display driving circuit according to claim 1, wherein the nth-level gate driving switching sub-circuit comprises: a (2n−1)th gate driving switching transistor, a gate electrode of which is connected to the switching control end, a first electrode of which is connected to the (2n−1)th gate line, and a second electrode of which is connected to the nth-level gate driving signal output end; and a 2nth gate driving switching transistor, a gate electrode of which is connected to the switching control end, a first electrode of which is connected to the nth-level gate driving signal output end, and a second electrode of which is connected to the 2nth gate line, and the nth-level light-emitting control switching sub-circuit comprises: a (2n−1)th light-emitting control switching transistor, a gate electrode of which is connected to the switching control end, a first electrode of which is connected to the (2n−1)th light-emitting control line, and a second electrode of which is connected to the nth-level light-emitting control signal output end; and a 2nth light-emitting control switching transistor, a gate electrode of which is connected to the switching control end, a first electrode of which is connected to the nth-level light-emitting control signal output end, and a second electrode of which is connected to the 2nth light-emitting control line.

7. The display driving circuit according to claim 6, wherein the (2n−1)th gate driving switching transistor and the (2n−1)th light-emitting control switching transistor are N-type transistors, and the 2nth gate driving switching transistor and the 2nth light-emitting control switching transistor are P-type transistors.

8. The display driving circuit according to claim 6, wherein the (2n−1)th gate driving switching transistor and the (2n−1)th light-emitting control switching transistor are P-type transistors, and the 2nth gate driving switching transistor and the 2nth light-emitting control switching transistor are N-type transistors.

9. The display driving circuit according to claim 1, wherein the N levels of display driving sub-circuits are arranged sequentially; and the nth-level display driving sub-circuit comprises the nth-level gate driving sub-circuit and the nth-level light-emitting control sub-circuit arranged sequentially, or the nth-level display driving sub-circuit comprises the nth-level light-emitting control sub-circuit and the nth-level gate driving sub-circuit arranged sequentially.

10. The display driving circuit according to claim 1, wherein an mth-level gate driving sub-circuit comprises an mth-level gate driving input end, and an mth-level light-emitting control sub-circuit comprises an mth-level light-emitting control input end; and the mth-level gate driving input end is connected to an (m−1)th-level gate driving signal output end of an (m−1)th-level gate driving sub-circuit, and the mth-level light-emitting control input end is connected to an (m−1)th-level light-emitting control signal output end of an (m−1)th-level light-emitting control sub-circuit, where m is an integer greater than 1 and smaller than or equal to N.

11. The display driving circuit according to claim 1, wherein the nth-level gate driving sub-circuit comprises a first transistor, a second transistor, a third transistor, a fourth transistor, a fifth transistor, a sixth transistor, a seventh transistor, an eighth transistor, a first storage capacitor and a second storage capacitor.

12. The display driving circuit according to claim 1, wherein the nth-level light-emitting control sub-circuit comprises a ninth transistor, a tenth transistor, an eleventh transistor, a twelfth transistor, a thirteenth transistor, a fourteenth transistor, a fifteenth transistor, a sixteenth transistor, a seventeenth transistor, an eighteenth transistor, a nineteenth transistor, a twentieth transistor, a twenty-first transistor, a third storage capacitor, a fourth storage capacitor and a fifth storage capacitor.

13. A display driving method of the display driving circuit according to claim 1, wherein a display period of the display driving circuit comprises an odd-numbered row display stage and an even-numbered row display stage, and the display driving method comprises:

at the odd-numbered row display stage, controlling, by an nth-level gate driving switching sub-circuit, an nth-level gate driving signal output end to be electrically connected to a (2n−1)th gate line under the control of a switching control end, and controlling, by an nth-level light-emitting control switching sub-circuit, an nth-level light-emitting control signal output end to be electrically connected to a (2n−1)th light-emitting control line under the control of the switching control end; and at the even-numbered row display stage, controlling, by the nth-level gate driving switching sub-circuit, the nth-level gate driving signal output end to be electrically connected to a 2nth gate line under the control of the switching control end, and controlling, by the nth-level light-emitting control switching sub-circuit, the nth-level light-emitting control signal output end to be electrically connected to a 2nth light-emitting control line under the control of the switching control end.

14. The display driving method according to claim 13, further comprising:

at the even-numbered row display stage, controlling, by the nth-level gate driving switching sub-circuit, the nth-level gate driving signal output end to be electrically disconnected from the (2n−1)th gate line under the control of the switching control end, and controlling, by the nth-level light-emitting control switching sub-circuit, the nth-level light-emitting control signal output end to be electrically disconnected from the (2n−1)th light-emitting control line under the control of the switching control end; and at the odd-numbered row display stage, controlling, by the nth-level gate driving switching sub-circuit, the nth-level gate driving signal output end to be electrically disconnected from the 2nth gate line under the control of the switching control end, and controlling, by the nth-level light-emitting control switching sub-circuit, the nth-level light-emitting control signal output end to be electrically disconnected from the 2nth light-emitting control line under the control of the switching control end.

15. The display driving method according to claim 13, wherein the display period comprises the odd-numbered row display stage and the even-numbered row display stage arranged sequentially, or the display period comprises the even-numbered row display stage and the odd-numbered row display stage arranged sequentially.

16. A display device, comprising the display driving circuit according claim 1.

* * * * *